US009302882B2

(12) United States Patent
Douillard et al.

(10) Patent No.: US 9,302,882 B2
(45) Date of Patent: Apr. 5, 2016

(54) COMPRESSIBLE ROLL TOP OF FORMER FOR MULTIRIBBON TRANSPORT

(75) Inventors: Gerald Roger Douillard, Manchester, NH (US); Douglas Joseph Dawley, Dover, NH (US); Daniel Matthew Perdue, Rochester, NH (US); Brian Robert Elkinson, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 1628 days.

(21) Appl. No.: 12/587,972

(22) Filed: Oct. 15, 2009

(65) Prior Publication Data

US 2011/0088578 A1 Apr. 21, 2011

(51) Int. Cl.
*B41F 13/56* (2006.01)
*B65H 45/22* (2006.01)

(52) U.S. Cl.
CPC ..... *B65H 45/221* (2013.01); *B65H 2404/143* (2013.01); *B65H 2404/185* (2013.01); *B65H 2404/563* (2013.01)

(58) Field of Classification Search
USPC ..... 101/231, 376
See application file for complete search history.

(56) References Cited

U.S. PATENT DOCUMENTS

| | | | | |
|---|---|---|---|---|
| 3,788,638 | A * | 1/1974 | Lehmann | 271/272 |
| 4,484,982 | A * | 11/1984 | Majaniemi | 162/358.3 |
| 5,328,437 | A | 7/1994 | Maylaender et al. | 493/357 |
| 5,716,311 | A | 2/1998 | Novick | |
| 5,904,094 | A | 5/1999 | Bredenberg | |
| 5,915,301 | A * | 6/1999 | Pollock | 101/227 |
| 6,030,330 | A | 2/2000 | Diehl | 493/355 |
| 6,338,707 | B1 * | 1/2002 | Michalik | 493/357 |
| 6,556,798 | B2 * | 4/2003 | Rimai et al. | 399/167 |
| 6,588,739 | B1 * | 7/2003 | Weis | 270/6 |
| 2002/0063541 | A1 * | 5/2002 | Cote et al. | 318/432 |
| 2006/0157924 | A1 | 7/2006 | Elkinson et al. | 271/272 |
| 2008/0150208 | A1 | 6/2008 | Elkinson | |

* cited by examiner

*Primary Examiner* — Jill Culler
(74) *Attorney, Agent, or Firm* — Davidson, Davidson & Kappel, LLC

(57) ABSTRACT

A folder superstructure includes a former, a first top of former roll located upstream of the former and having a compressible outer layer and a second top of former roll forming a nip with the first top of former roll. A method for operating a printing press is also provided.

14 Claims, 3 Drawing Sheets

COMPRESSIBLE ROLL TOP OF FORMER FOR MULTIRIBBON TRANSPORT

The present invention relates generally to folder superstructures for web printing presses, to nip rolls used in multiribbon transport, as well as to a method for operating a printing press.

BACKGROUND INFORMATION

As described in U.S. Patent Application Publication 2006/0157924, hereby incorporated by reference herein, in a web printing press, a web or webs may be printed in various printing units. The webs then may enter a folder superstructure. There, the webs may be slit into ribbons, which are then superimposed to form a ribbon bundle, before passing to a former. The ribbon bundle in the folder superstructure may be drawn over a roller at the top of the former called an RTF by driven nip rolls located after the nose of the former. The ribbon bundle then may pass to a folder where the ribbon bundle is cut into signatures.

The nip rolls may be spring-loaded against each other in an adjustable manner so as to set the pressure or "squeeze." Nip rolls with urethane or rubber outer layers are known. These rubber or urethane coatings are incompressible, as no air, microspheres or other gas inclusions are added to make them compressible. U.S. 2006/0157924 describes a folder superstructure in which these nip rolls, which are located downstream of the former, have a compressible outer layer. This compressible outer layer can be made of microcellular foamed urethane or foamed rubber, and may have a Poisson's ratio of 0.5 or less. The microcellular foamed urethane may, for example, be 40 durometer with a poisson's ratio of 0.35.

A ribbon bundle may, for example, have six ribbons. The draw nip of the nip rolls can create uneven upstream longitudinal tensions of the different ribbons. A small change in nip pressure can also create large ribbon tension changes. To address uneven web tensions, gathering rolls or additional driven pull rolls upstream of the RTF are known.

Sometimes, the RTF can be a hard roll paired with a relatively soft nip roll. The nip that may be formed by the hard-soft nip roll often produces tension differences among the ribbons that pass through the nip. The RTF nip may be effective in both reducing the amount of air entrained between the ribbons as well as reducing the lateral motion of the ribbons along the RTF roll.

BRIEF SUMMARY OF THE INVENTION

Tension differences may be minimized, for example, via a reduction in the angle of paper wrap over the RTF and a reduction in the nip squeeze. However, both of these approaches may reduce the ability of the nip to remove the entrained air between the ribbons and decrease the ability to prevent ribbon weave.

The present invention provides a folder superstructure including: a former; a first top of former roll located upstream of the former and having a compressible outer layer; and a second top of former roll forming a nip with the first top of former roll.

The present invention also includes a method for operating a printing press including: printing at least one web; forming a plurality of ribbons from the at least one web; and passing the ribbon bundle through top of former rolls located upstream of the former, at least one of the top of former rolls having a compressible layer.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
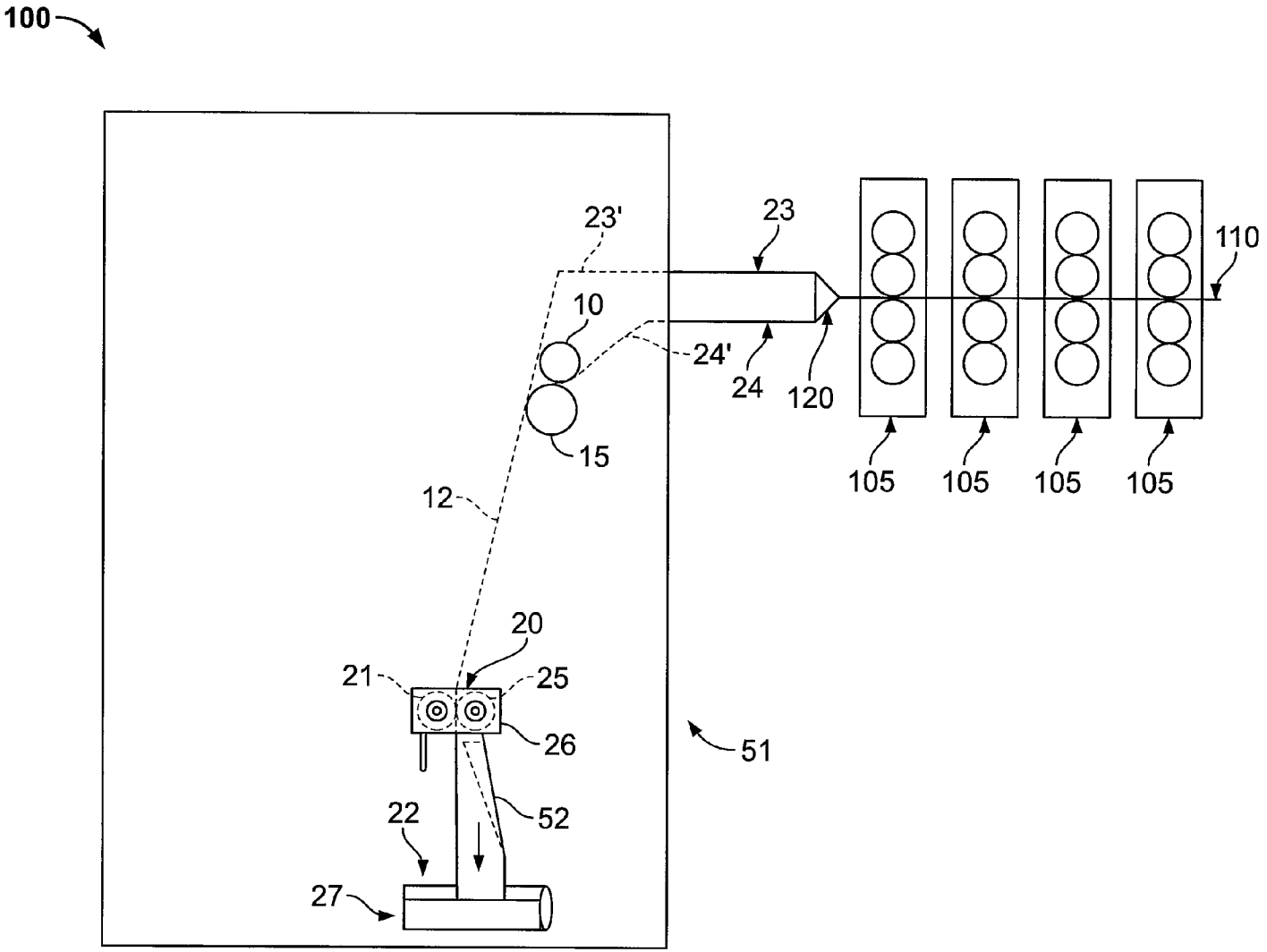
FIG. 1 shows schematic view of a web printing press according to the present invention.

FIG. 1 shows a schematic view of a web printing press 100 according to the present invention. Printing press 100 includes printing units 105, printing on a web 110. A slitting device 120 slits web 110 into ribbon bundles 23, 24, which enter folder superstructure 51 (shown as 23' and 24') and are guided to former 52 by driven lead rolls 10, 15 and RTF 26. As one of skill in the art will readily recognize, if additional ribbons are received by the folder superstructure 51, additional sets of lead rolls will be necessary, one set of lead rolls for each additional ribbon. The ribbons 23' and 24' are joined after the driven lead rolls 10, 15 and ribbon bundle 12 consists of ribbons 23' and 24'. Former 52 longitudinally folds ribbon bundle 12 as ribbon bundle 12 is drawn by driven nip rolls 22, 27, respectively.

Ribbon bundle 12 is directed towards a ribbon nip entry 20 in RTF 26. RTF 26 includes top of former rolls 21, 25, which may be compressible. Ribbon bundle 12 enters ribbon nip entry 20 and passes through top of former rolls 21, 25. Top of former rolls 21, 25 may then guide ribbon bundle 12 towards a former 52. Once ribbon bundle 12 reaches former 52, former 52 may then impart a longitudinal fold to the ribbon bundle 12, which is drawn over the former 52 by infeed rollers 22, 27, respectively. However, it is also possible that ribbon bundle 12 may be gathered by RTF 26 without necessarily going over former 52.

Figure 2:
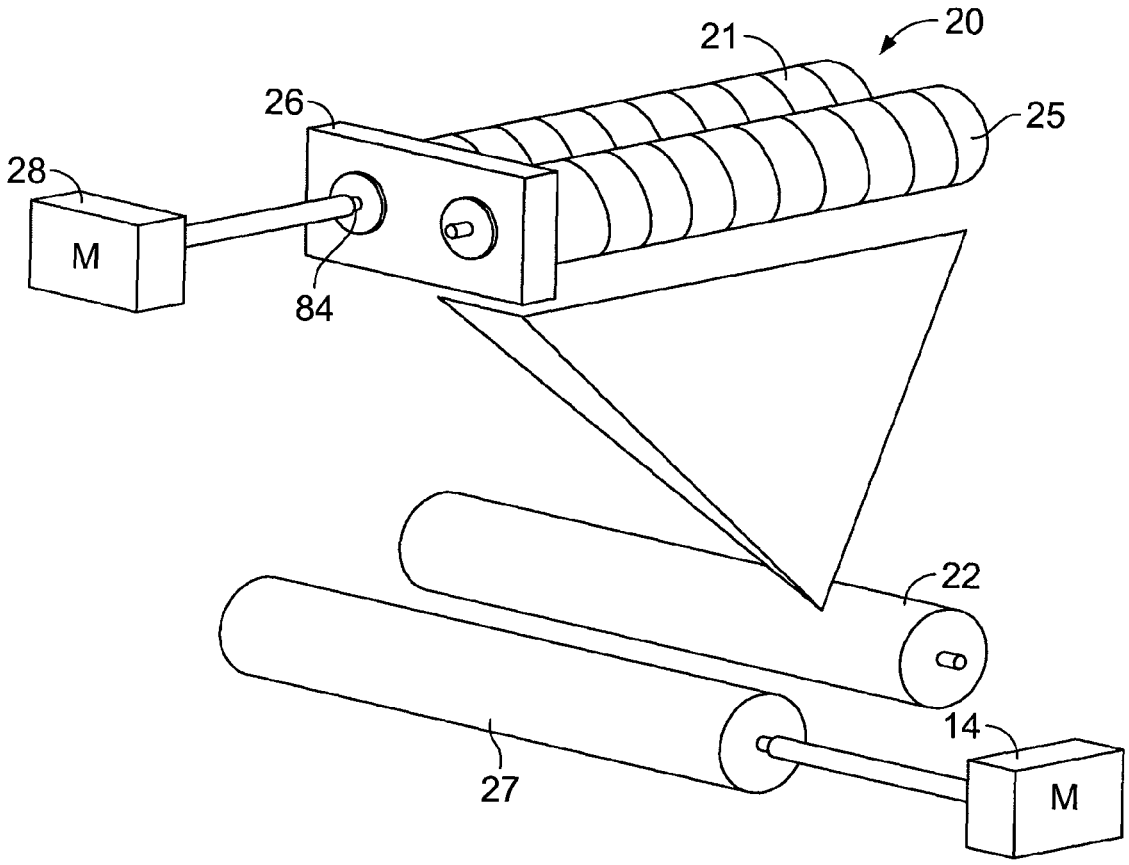
FIG. 2 shows a side view of a portion of a folder superstructure of the printing press shown in FIG. 1.

As shown in FIG. 2, a mechanical connection to a main drive for the folder superstructure 51 or drive motor 14 can drive infeed rollers 22, 27, which may be compressible or be similar to top of former rolls 21, 25, to pull ribbon bundle 12. Top of former rolls 21, 25 in RTF 26 may be driven by a mechanical connection to a main drive for the folder superstructure 51 or alternately be independently motor driven by drive motor 28 or need not be driven at all. The axes of top of former rolls 21, 25 are adjustable with respect to each other (see FIG. 3) to alter nip pressure, also known as squeeze.

Ribbon bundle 12 is configured in such a way as to enable it to enter ribbon nip entry 20 in a manner as to minimize tension differences related to a nip entry angle. For the purposes of this disclosure, the nip entry angle may be defined as angle A (see FIG. 3) created by ribbon bundle 12 entering the ribbon nip entry 20 and a line of centers of top of former rolls 21, 25 in RTF 26. When the nip entry angle is ninety (90) degrees, the tension differences among ribbons 23, 24 may be minimized.

Figure 3:
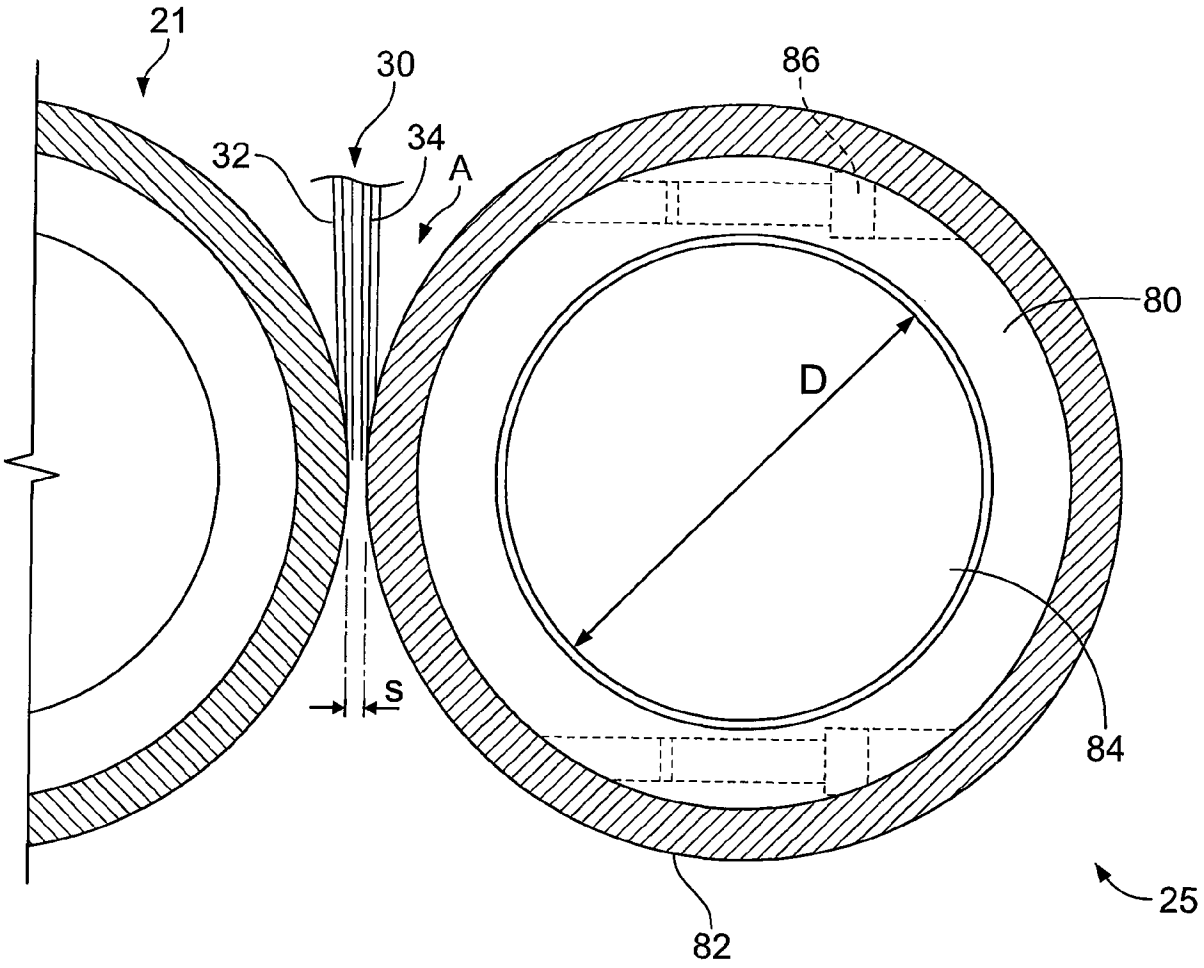
FIG. 3 shows a side view of an RTF according to the present invention.

FIG. 3 shows top of former roll 25, which has a body 80, made for example of steel, about which is a compressible outer layer 82 made of, for example, microcellular foamed urethane of 40 durometer with, for example, a Poisson's ratio of 0.35. Preferably, the Poisson's ratio for the outer layer, which may be made of foamed rubber, or any other suitable material, is 0.5 or less. Preferably, gas inclusions, such as air, are provided during manufacture of top of former roll 21. Body 80, for example, may be placed in a mold and urethane foamed around an outer surface of body 80 may form outer layer 82. Body 80 may be hollow with an inner diameter D and may be driven by a mechanical connection via an axle 84 to a main drive for folder superstructure 51 or alternately be independently motor driven by drive motor 28 (FIG. 2) or need not be driven at all. Screws and bolts 86 may be used to fix body 80 to axle 84.

Top of former roll 21 may be driven by a mechanical connection to a main drive for folder superstructure 51 or alternately be motor driven by a motor similar to drive motor 28 or need not be driven at all. Top of former roll 21, for example, may be adjustable with respect to top of former roll 25 to set a squeeze S. Top of former roll 21 preferably may be similar in construction to top of former roll 25.

As a ribbon bundle 30, in this example with six ribbons, passes through the nip between top of former rolls 21 and 25, the tension downstream from the nip varies between the ribbons. Thus, for example, an outermost ribbon 32 will have a different tension in the longitudinal direction than ribbon 34. Advantageously, it has been found that the use of top of former rolls 21, 25 with compressible outer layers according to the present disclosure may reduce the amount of tension between ribbons 32, 34 in ribbon bundle 30. Thus, lead rolls 10, 11, for example, may not need to be adjusted as much or as far. Make-ready times and set-up may be reduced. Change in squeeze or pressure also does not result in as large ribbon-to-ribbon tension changes as with incompressible rolls, and thus pressure adjustments may be simplified.

An exit angle of RTF 26 may be set to an angle, for example, eight degrees, which could allow center slitting or perforation of the ribbon bundle. An anvil and knife of the slitter or perforator system could be concentric with the nip between top of former rolls 21 and 25.

The method of operation may include that RTF 26 is thrown off and adjusted in such a way so that the location of the ribbon bundle exiting the nip between top of former rolls 21 and 25 may be controlled relative to former 2

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A folder superstructure comprising:

a former;

a first top of former roll located upstream of the former and having a compressible outer layer; and a second top of former roll forming a nip with the first top of former roll.

2. The folder superstructure as recited in claim 1 wherein the second top of former roll includes a second compressible outer layer.

3. The folder superstructure as recited in claim 1 wherein at least one of the first and second top of former rolls is driven.

4. The folder superstructure as recited in claim 3 further comprising an individual drive motor connected to at least one of the of the first and second top of former rolls.

5. The folder superstructure as recited in claim 1 wherein a nip entry angle is ninety degrees.

6. The folder superstructure as recited in claim 1 wherein the compressible outer layer is made of a foamed material.

7. The folder superstructure as recited in claim 1 wherein the compressible outer layer has a Poisson's ratio of 0.50 or less.

8. The folder superstructure as recited in claim 1 wherein the compressible outer layer is made of urethane with gas inclusions.

9. The folder superstructure as recited in claim 1 wherein the compressible outer layer is made of rubber with gas inclusions.

10. The folder superstructure as recited in claim 1 further comprising nip rollers at a nose of the former.

11. The folder superstructure as recited in claim 10 wherein the nip rollers include a compressible layer.

12. The folder superstructure as recited in claim 10 wherein the nip rollers are driven.

13. The folder superstructure as recited in claim 10 wherein the nip rollers have an axis of rotation ninety degrees from an axis of rotation of the first top of former roll.

14. A method for operating a printing press comprising:

printing at least one web;

forming a plurality of ribbons from the at least one web; and passing a ribbon bundle through top of former rolls located upstream of a former, at least one of the top of former rolls having a compressible layer.

* * * * *